US012285106B2

(12) United States Patent
Dai

(10) Patent No.: US 12,285,106 B2
(45) Date of Patent: Apr. 29, 2025

(54) ADJUSTABLE DIVIDER

(71) Applicant: ShenZhen YiHong Technology Co., LTD, Shenzhen (CN)

(72) Inventor: Yi Dai, Shenzhen (CN)

(73) Assignee: ShenZhen YiHong Technology Co., LTD, Shenzhen (CN)

( * ) Notice: Subject to any disclaimer, the term of this patent is extended or adjusted under 35 U.S.C. 154(b) by 93 days.

(21) Appl. No.: 18/450,426

(22) Filed: Aug. 16, 2023

(65) Prior Publication Data

US 2025/0031848 A1 Jan. 30, 2025

(30) Foreign Application Priority Data

Jul. 27, 2023 (CN) ..... 202322004122.5

(51) Int. Cl.
*A47B 88/975* (2017.01)

(52) U.S. Cl.
CPC ..... *A47B 88/975* (2017.01)

(58) Field of Classification Search
CPC ..... A47B 88/969; A47B 88/975
USPC ..... 312/348.3
See application file for complete search history.

(56) References Cited

U.S. PATENT DOCUMENTS 1,849,024 A * 3/1932 Mckee ..... A47B 88/969 220/551
4,607,455 A * 8/1986 Bluem ..... E06B 11/02 49/55
5,442,881 A * 8/1995 Asbach ..... E05B 65/0007 49/55
5,570,543 A * 11/1996 Bishop ..... E05B 65/0014 49/55
5,924,242 A * 7/1999 Macari ..... E06B 9/02 49/55
7,645,001 B2 * 1/2010 Harris ..... A47B 96/025 312/205
9,549,623 B1 * 1/2017 Snell ..... A47B 88/975
10,219,623 B1 * 3/2019 Dibdin ..... A47F 5/005
10,674,652 B2 6/2020 Ricketts et al.
11,375,666 B2 7/2022 Baes et al.
11,405,025 B1 8/2022 Hao et al.
(Continued)

FOREIGN PATENT DOCUMENTS

DE 20008444 * 10/2001 ..... A47B 88/20

*Primary Examiner* — James O Hansen
(74) *Attorney, Agent, or Firm* — True Shepherd LLC; Andrew C. Cheng

(57) ABSTRACT

An adjustable divider includes: a first divider member, a second divider member, a third divider member, and a stop mechanism. The second divider member is located between the first divider member and the third divider member; the first divider member is movably connected to the second divider member; the second divider member is movably connected to the third divider member; an elastic member is arranged between the second divider member and the third divider member; the stop mechanism is mounted in the first divider member; and a positioning rack is arranged in the second divider member. When the stop mechanism is engaged with the positioning rack, the second divider member can only move in one direction; and when the stop mechanism is separated from the positioning rack, the second divider member can move freely on the first divider member.

8 Claims, 4 Drawing Sheets

(56) References Cited

U.S. PATENT DOCUMENTS

| | | | | |
|---|---|---|---|---|
| 2003/0137227 | A1* | 7/2003 | Hoenig | A47B 88/90<br>312/348.3 |
| 2003/0184198 | A1* | 10/2003 | Bodingbauer | A47B 88/90<br>312/348.3 |

* cited by examiner

ADJUSTABLE DIVIDER

CROSS-REFERENCE TO RELATED APPLICATIONS

This application claims priority to Chinese Patent Application No. 202322004122.5 with a filing date of Jul. 27, 2023. The content of the aforementioned application, including any intervening amendments thereto, is incorporated herein by reference.

TECHNICAL FIELD

The present disclosure relates to the technical field of household supplies, and in particular, to an adjustable divider.

BACKGROUND

With the improvement of our living standards, people have higher requirements for storage space, such as drawers and wardrobes. Dividers are now commonly used for storage space in response to the requirements. At present, there are many types of dividers on the market, and spacer or spring-type dividers, push-type dividers, and viscose-type dividers are most commonly used.

The working principle of the spring-type dividers is mainly as follows: a spring is placed directly under a telescopic rod to provide a pressure to fix a partition in a drawer. However, the spring-type partition needs to extremely compress the spring when the drawer is too short, making it difficult for users to use.

The working principle of the press-type dividers is mainly as follows: when a button is lifted, teeth on a telescopic rod are separated from teeth on the button, and the telescopic rod can move freely. When the telescopic rod is pulled down to a suitable length, the button is pressed, and the teeth on the lever button are engaged with the teeth on the telescopic rod to push the telescopic rod to move a pitch. However, when the difference between the length of a drawer and a press-type drawer partition is just within the range of half a pitch, making it difficult to press the button. Reducing the range of the pitch will easily cause tooth slipping, resulting in the failure of the press-type drawer partition.

With this regard, the present disclosure provides a novel adjustable divider, which can deal with the storage space of various lengths without the problem of insufficient pressure or difficulty in compression. In addition, the adjustable divider can also ensure that when the length of the storage space is at a sensitive distance from the adjustable divider, the button can be easily pressed to save time and labor.

SUMMARY OF PRESENT INVENTION

An objective of the present disclosure is to provide a novel adjustable divider to overcome various deficiencies in existing adjustable dividers.

To solve the technical problems above, the embodiments of the present disclosure provide an adjustable divider, including: a first divider member, a second divider member, a third divider member, and a stop mechanism; the second divider member is located between the first divider member and the third divider member; the first divider member is movably connected to the second divider member; the second divider member is movably connected to the third divider member; the stop mechanism is mounted in the first divider member; a positioning rack is arranged in the second divider member; an elastic member is arranged between the second divider member and the third divider member.

The stop mechanism includes a stop member and a moving member; the stop member is engaged with the positioning rack; the moving member is movably connected to the first divider member, and abuts against the stop member; the moving member is configured to control engagement and separation of the stop member and the positioning rack; and when the stop member is engaged with the positioning rack, the moving member is further configured to control the stop member to move, such that the second divider member is only capable of moving in one direction.

Preferably, the stop member includes movable teeth and a movable rod; the movable teeth are engaged with the positioning rack, and the movable rod abuts against the moving member; the movable teeth and the movable rod are integrally formed; a fixing shaft is provided at a junction between the movable teeth and the movable rod, and the fixing shaft is configured to fix the movable teeth and the movable rod on the first divider member, such that the movable teeth are only capable of performing circumferential movement.

Preferably, a blocking plate is arranged in the moving member; and when the movable teeth are engaged with the positioning rack, the blocking plate abuts against the first divider member, and the movable teeth are only capable of performing circumferential movement in one direction.

Preferably, the stop member further includes a torsion spring; the torsion spring is twisted on the movable teeth and the movable rod; and the movable teeth and the movable rod return to an original position when no external force is applied.

Preferably, the movable teeth face the second divider member.

Preferably, teeth on the positioning rack face the first divider member.

Preferably, the third divider member includes an extension portion, and the second divider member includes a first groove; the elastic member is a spring, one end of the spring is fixed in the first groove, and other end of the spring abuts against the extension portion.

Preferably, a coupling portion is formed on an inner wall of the first groove, a second groove is formed in the extension portion, and the coupling portion is located in the second groove to prevent the extension portion of the third divider member from being separated from the first groove.

Preferably, a first antiskid pad is provided at one end of the first divider member away from the second divider member.

Preferably, a second antiskid pad is provided at one end of the third divider member away from the second divider member.

The embodiments of the present disclosure have the following beneficial effects:

(1) When the stop member is engaged with the positioning rack, the moving member controls the stop member to move. In this case, the second divider member can only move along a direction away from the first divider member, and the third divider member is compressed to easily fix the partition on an inner wall of the storage space. When the stop member is separated from the positioning rack, under the action of the elastic member, the second divider member moves along a direction close to the first divider member, until there is no pressure between the partition and the inner wall of the storage space, thereby easily removing the partition.

Both use and removal are easy and simple, and a similar pressure can be provided in the face of storage space of various lengths.

(2) The stop member is fixed on the first divider member through the fixing shaft, such that the movable teeth can only perform circumferential movement. The moving member controls the movable teeth to move only in one direction, such that the positioning rack can only move in a direction away from the first divider member when being engaged with the movable teeth. In this way, it is ensured that the telescopic length can be fixed when the partition is in use, and the partition is effectively fixed on the inner wall of the storage space.

(3) The second divider member is connected to a protruding portion of the third divider member through a spring in the first groove, and is matched with the second groove on the protruding portion through the coupling portion of the first groove, such that the third divider member can be easily compressed into the second divider member. Therefore, it is ensured that the partition can provide a suitable pressure in the face of storage space of various lengths.

BRIEF DESCRIPTION OF THE DRAWINGS

To describe the technical solutions in the embodiment of the present disclosure or in the prior art more clearly, the following briefly introduces the accompanying drawings required for describing the embodiment or the prior art. Apparently, the accompanying drawings in the following description show merely some embodiments of the present disclosure, and a person of ordinary skill in the art may still derive other drawings from these accompanying drawings without creative efforts.

Figure 1:
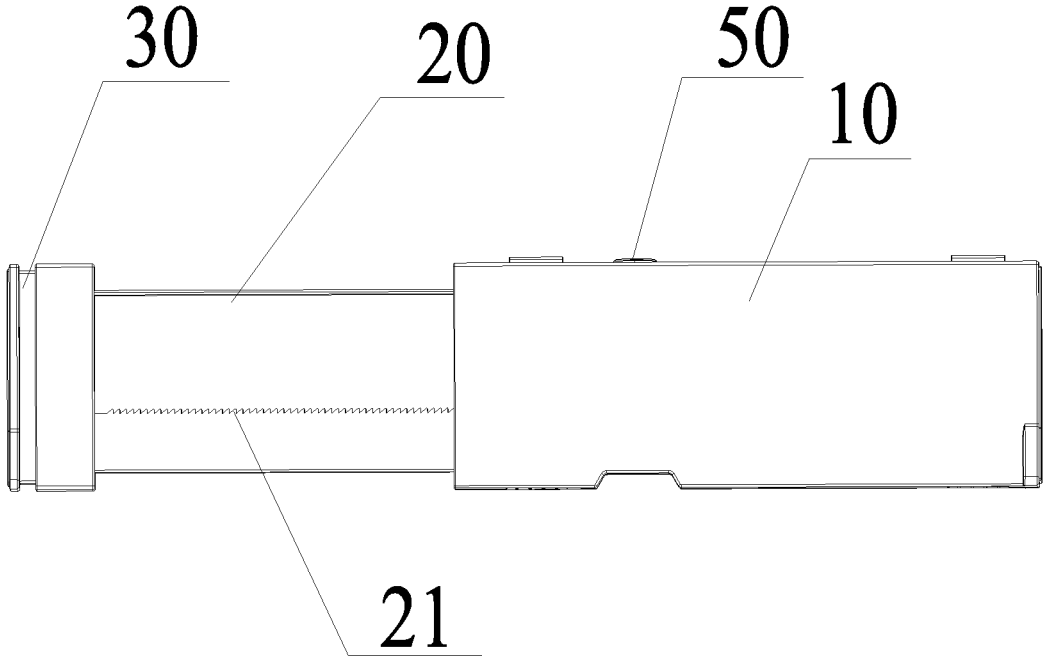
FIG. 1 is a structural schematic diagram showing an adjustable divider according to one embodiment of the present disclosure.

Reference numerals: 10—First divider member, 11—First antiskid pad, 20—Second divider member, 21—Positioning rack, 22—First groove, 221—Elastic member, 222—Coupling portion, 30—Third divider member, 31—Second antiskid pad, 32—Protruding portion, 321—Second groove, 40—Stop member, 41—Movable tooth, 42—Movable rod, 43—Torsion spring, 44—Fixing shaft, 50—Moving member, 51—Blocking plate, and 60—Stop mechanism.

DETAILED DESCRIPTION OF THE EMBODIMENTS

The technical solutions in embodiments of the present disclosure will be described below clearly and completely with reference to the accompanying drawings in the embodiments of the present disclosure. Apparently, the described embodiments are merely some, rather than all of the embodiments of the present disclosure. All other embodiments derived from the embodiments of the present disclosure by those of ordinary skill in the art without creative efforts shall fall within the protection scope of the present disclosure.

Figure 2:
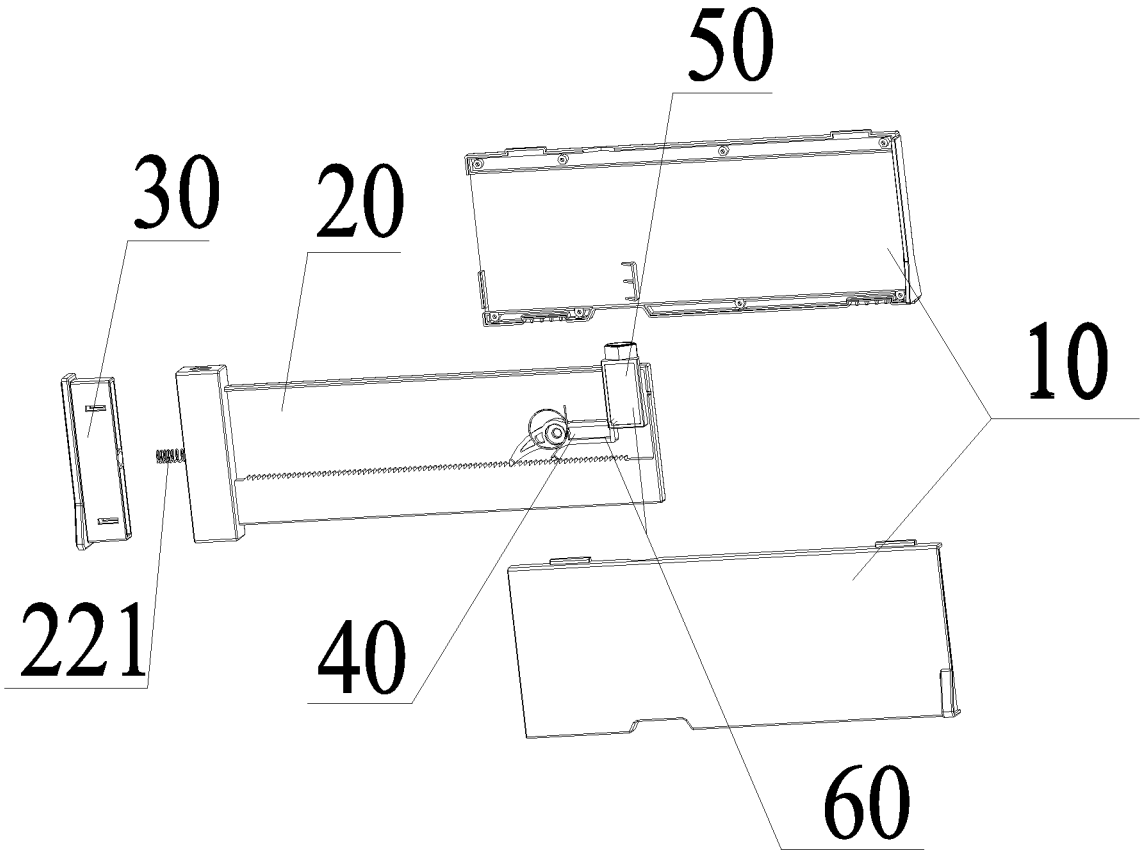
FIG. 2 is an exploded view showing the adjustable divider according to the embodiment of the present disclosure.

Referring to FIG. 1 and FIG. 2, an embodiment of the present disclosure provides an adjustable divider, including a first divider member 10, a second divider member 20, a third divider member 30, and a stop mechanism 60. The second divider member 20 is located between the first divider member 10 and the third divider member 30. The first divider member 10 is movably connected to the second divider member 20. The second divider member 20 is movably connected to the third divider member 30. An elastic member 221 is arranged between the second divider member and the third divider member, and the third divider member 30 can be compressed to the second divider member 20 to reduce the overall length of the adjustable divider. The stop mechanism 60 is mounted in the first divider member 10; and a positioning rack 21 is arranged in the second divider member 20.

The stop mechanism 60 includes a stop member 40 and a moving member 50. The stop member 40 is engaged with the positioning rack 21. The moving member 50 is movably connected to the first divider member 10, and can move on the first divider member 10 up and down. The moving member 50 abuts against the stop member 40, and can drive the stop member 40 to move downward. The moving member 50 is configured to control engagement and separation of the stop member 40 and the positioning rack 21. When the stop member 40 is engaged with the positioning rack 21, the moving member 50 is further configured to control the stop member 40 to move, such that the second divider member 20 can only move in one direction.

Figure 3:
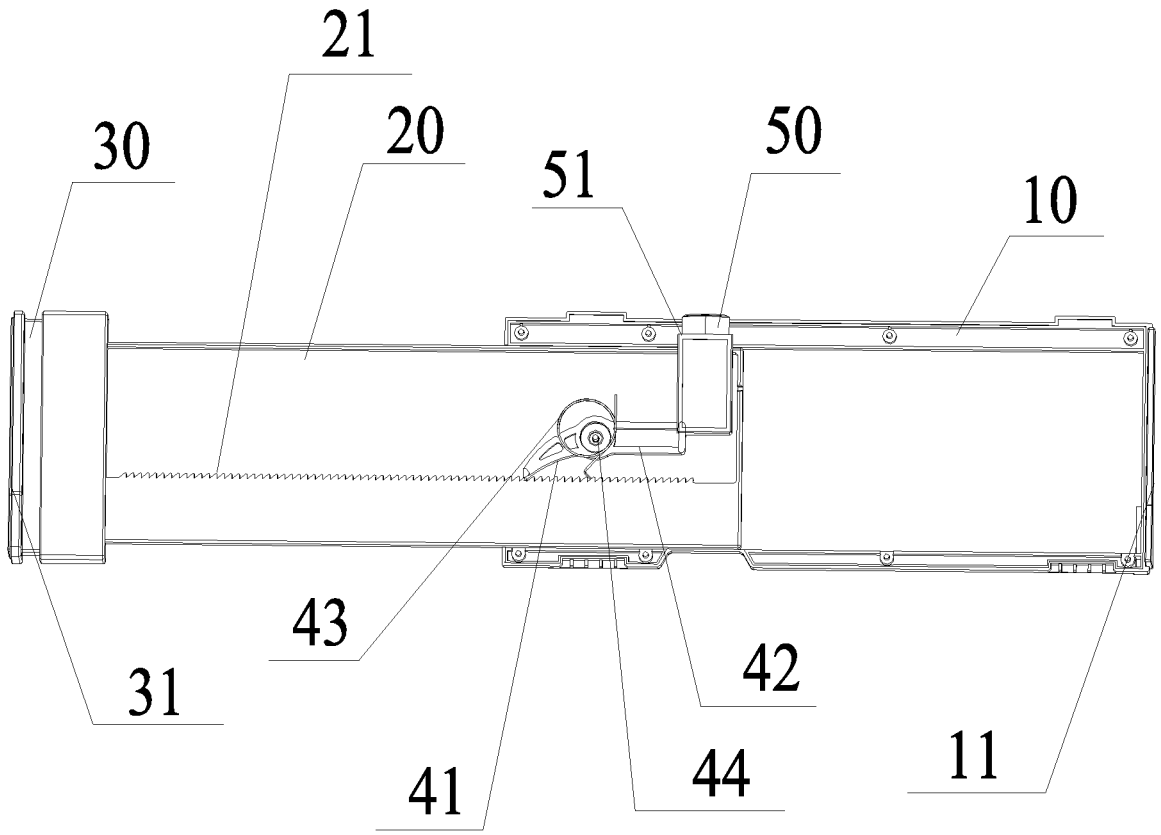
FIG. 3 is a structural schematic diagram showing a stop mechanism according to one embodiment of the present disclosure.

Referring to FIG. 3, the stop member 40 includes movable teeth 41, a movable rod 42, a torsion spring 43, and a fixing shaft 44. A blocking plate 51 is provided on the moving member 50. The movable teeth 41 and the movable rod 42 are integrally formed. The fixing shaft 44 is located at a junction between the movable teeth 41 and the movable rod 42, and the movable teeth 41 and the movable rod 42 are fixed on the first divider member 10, such that the movable teeth 41 and the movable rod 42 can only perform circumferential movement. The torsion spring 43 is twisted on the movable teeth 41 and the movable rod 42; and the movable teeth 41 and the movable rod 42 return to an original position when no external force is applied. The movable teeth 41 are engaged with the positioning rack 21. The moving member 50 is located above the movable rod 42, and abuts against the movable rod 42. The blocking plate 51 disposed on the moving member 50 abuts against the first divider member 10 to limit the upward movement distance of the moving member 50. When the movable teeth 41 are engaged with the positioning rack 21, the blocking plate 51 abuts against the first divider member 10, and the movable teeth 41 and the movable rod 42 cannot rotate anticlockwise.

In some embodiments, the movable teeth 41 face the second divider member 20, and teeth on the positioning rack 21 face the first divider member 10. When the movable teeth 41 are engaged with the positioning rack 21, the second divider member 20 moves along a direct close to the first divider member 10, such that it is difficult to cause the tooth slipping phenomenon.

When the movable teeth 41 are engaged with the positioning rack 21, the second divider member 20 can only move along a direct away from the first divider member 10. Every time the movable teeth 41 straddle a tooth on the positioning rack 21, the movable teeth 41 first rotate clockwise and then counterclockwise. The moving member 50 is also displaced first downwards and then upwards. When the second divider member 20 wants to horizontally move along a direction close to the first divider member 10, the movable teeth 41 and the movable rod 42 rotate anticlockwise; the moving member 50 is displaced upwards, and the blocking plate 51 abuts against the first divider member 10, such that the moving member 50 cannot be displaced upwards; and the second divider member 20 cannot move along the direction close to the first divider member 10. When the movable teeth 41 are engaged with the positioning rack 21, the moving member 50 controls the stop member 40 to move, such that the second divider member 20 can only move in one direction.

The moving member 50 is directly displaced downwards, the movable rod 42 rotates clockwise, and the movable teeth 41 also rotate clockwise to be directly separated from the positioning rack 21. There is no restriction on the positioning rack 21, and the second divider member 20 can be freely displaced on the first divider member 10.

Figure 4:
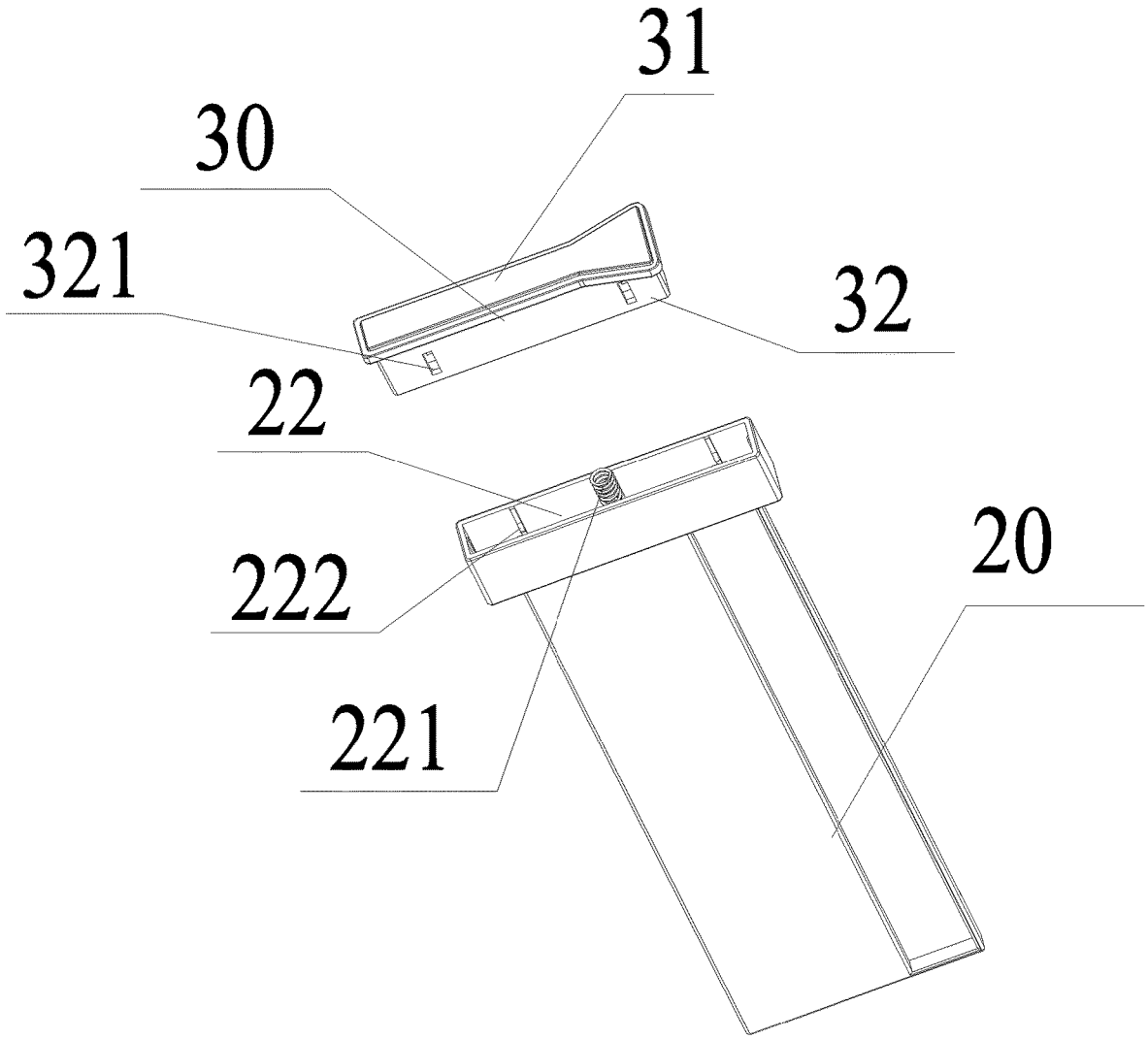
FIG. 4 is an exploded view of a second divider member and a third divider member according to the embodiment of the present disclosure.

Referring to FIG. 4, the second divider member 20 further includes a first groove 22. An elastic member 221 is provided in the first groove 22, and a coupling portion 222 is formed on an inner wall of the first groove 22. The third divider member 30 further includes an extension portion 32, and a second groove 321 is formed in the extension portion 32. The extension portion 32 is matched with the first groove 22. The other end of the elastic member 221 is connected to the extension portion 32. The coupling portion 222 is located in the second groove 321 to prevent the extension portion 32 from being completely separated from the first groove 22. The extension portion 32 is partially embedded in the first groove 22, such that the third divider member 30 can be easily compressed into the second divider member 20. The compression distance is far greater than the width of one tooth of the positioning rack 21, thereby providing an enough pressure to fix the adjustable divider on the inner wall of the storage space.

In some embodiments, the elastic member 221 is a spring structure.

In use, the moving member 50 reaches a highest displacement under the action of the torsion spring 43 and the blocking plate 51. At this time, the movable teeth 41 are engaged with the positioning rack 21, most of the second divider member 20 is located inside the first divider member 10, and the adjustable divider reaches a smallest length. The first divider member 10 is close to the inner wall of the storage space, and the second divider member 20 is pulled to the other inner wall of the storage space in a direction away from the first divider member 10, such that the third divider member 30 is in contact with the other inner wall. At this time, the movable teeth 41 and the movable rod 42 continuously make movement of small rotation clockwise first and then small counterclockwise rotation. The moving member 50 continuously makes movement of small downward displacement first and then upward displacement. The second divider member 20 continues to press against the other inner wall. The elastic member 221 is compressed, and the second divider member 20 continues to stretch. When the pressure is within a reasonable range, the movement of the second divider member 20 is stopped. Since the elastic member is compressed, the second divider member 20 is urged to move inwardly, i.e., to the right. The movable teeth 41 and the movable rod 42 rotate anticlockwise. The moving member 50 is displaced upwards, and the blocking plate 51 abuts against the first divider member 10, such that the moving member 50 cannot be displaced upwards. The second divider member 20 cannot horizontally move to the right. The second divider member 20 is fixed, and the adjustable divider is fixed inside the storage space to distinguish the storage space.

When the adjustable divider is removed from the storage space, the moving member 50 is displaced downwards, the movable rod 42 rotates clockwise, and the movable teeth 41 also rotate clockwise to be directly separated from the positioning rack 21. Since the elastic member 221 is compressed, the second divider member 20 moves in the direction close to the first divider member 10, until the elastic member 221 returns to a state where the adjustable divider is not in use, and the second divider member 20 is stopped moving. At this time, the first divider member 10 and the third divider member 30 are in contact with the inner wall of a drawer, but there is no the action of a force at the junction of the two, and the adjustable divider is easily removed from the storage space.

In some embodiments, a first antiskid pad 11 and a second antiskid pad 31 are respectively provided at one end of the first divider member 10 and one end of the third divider member 30 in contact with the inner wall of the drawer. The first antiskid pad 11 and the second antiskid pad 31 are configured to increase a friction force between the adjustable divider and the inner wall of the drawer, such that when a pressure provided by the adjustable divider for the inner wall of the drawer is small, the adjustable divider can also be firmly fixed on the inner wall of the drawer.

The foregoing disclosed is merely one preferred embodiment of the present disclosure, and certainly shall not be used to limit the scope of the claims of the present disclosure. A person of ordinary skill in the art can understand all or some of the procedures for implementing the foregoing embodiment and make equivalent changes according to the claims of the present disclosure. The equivalent changes still fall within the scope of the present disclosure.

What is claimed is:

1. An adjustable divider, comprising: a first divider member, a second divider member, a third divider member, and a stop mechanism, wherein the second divider member is located between the first divider member and the third divider member; the first divider member is movably connected to the second divider member; the second divider member is movably connected to the third divider member; the stop mechanism is mounted in the second divider member; a positioning rack is arranged in the second divider member; and an elastic member is arranged between the second divider member and the third divider member; and the stop mechanism comprises a stop member and a moving member; the stop member is engaged with the positioning rack; the moving member is movably connected to the first divider member, and abuts against the stop member; the moving member is configured to control engagement and separation of the stop member and the positioning rack; and when the stop member is engaged with the positioning rack, the moving member is further configured to control the stop member to move, such that the second divider member is only capable of moving in one direction;

wherein the third divider member comprises an extension portion, and the second divider member comprises a first groove; the elastic member is a spring, one end of the spring is fixed in the first groove, and an other end of the spring abuts against the extension portion;

wherein a coupling portion is formed on an inner wall of the first groove, a second groove is formed in the extension portion, and the coupling portion is located in the second groove to prevent the extension portion of the third divider member from being separated from the first groove.

2. The adjustable divider according to claim 1, wherein the stop member comprises movable teeth and a movable rod; the movable teeth are engaged with the positioning rack, and the movable rod abuts against the moving member; the movable teeth and the movable rod are integrally formed; a fixing shaft is provided at a junction between the movable teeth and the movable rod, and the fixing shaft is configured to fix the movable teeth and the movable rod on the second divider member, such that the movable teeth are only capable of performing circumferential movement.

3. The adjustable divider according to claim 2, wherein a blocking plate is provided on the moving member; and when the movable teeth are engaged with the positioning rack, the blocking plate abuts against the first divider member, and the movable teeth are only capable of performing circumferential movement in one direction.

4. The adjustable divider according to claim 2, wherein the stop member further comprises a torsion spring; the torsion spring is twisted on the movable teeth and the movable rod; and the movable teeth and the movable rod return to an original position when no external force is applied.

5. The adjustable divider according to claim 2, wherein the movable teeth face the positioning rack.

6. The adjustable divider according to claim 2, wherein teeth on the positioning rack face the movable teeth.

7. The adjustable divider according to claim 1, wherein a antiskid pad is provided at one end of the first divider member away from the second divider member.

8. The adjustable divider according to claim 1, wherein a antiskid pad is provided at one end of the third divider member away from the second divider member.

* * * * *